US008002369B2

(12) United States Patent
Bello

(10) Patent No.: US 8,002,369 B2
(45) Date of Patent: Aug. 23, 2011

(54) SLIDE SYSTEM FOR DRAWERS OR SHELVES IN AN APPLIANCE

(75) Inventor: Jorge Eduardo Chagoya Bello, Naucalpan de Juarez (MX)

(73) Assignee: Mabe Mexico, S. de R.L. de C.V., Queretaro (MX)

( * ) Notice: Subject to any disclaimer, the term of this patent is extended or adjusted under 35 U.S.C. 154(b) by 463 days.

(21) Appl. No.: 12/146,818

(22) Filed: Jun. 26, 2008

(65) Prior Publication Data

US 2009/0001865 A1 Jan. 1, 2009

(30) Foreign Application Priority Data

Jun. 28, 2007 (MX) ..... MX/A/2007/008018

(51) Int. Cl.
*A47B 96/04* (2006.01)

(52) U.S. Cl. ..... 312/410; 312/408; 312/334.228; 312/334.8; 312/404

(58) Field of Classification Search ..... 312/408, 312/410, 402, 404, 334.4, 334.7, 334.8, 334.22, 312/334.44; 62/442
See application file for complete search history.

(56) References Cited

U.S. PATENT DOCUMENTS

| | | | | |
|---|---|---|---|---|
| 888,512 | A | 5/1908 | Kurz | |
| 3,288,302 | A | 11/1966 | Fitzpatrick et al. | |
| 3,975,071 | A | 8/1976 | Quinn | |
| 4,057,872 | A | 11/1977 | Schmidt | |
| 5,209,555 | A | 5/1993 | Camilleri | |
| 5,918,959 | A | 7/1999 | Lee | |
| 6,056,378 | A | 5/2000 | Semon et al. | |
| 6,148,813 | A * | 11/2000 | Barnes et al. | 126/339 |
| 6,231,143 | B1 | 5/2001 | Stijns | |
| 6,578,720 | B1 | 6/2003 | Wang | |
| 6,926,001 | B2 | 8/2005 | Bartley | |
| 6,938,617 | B2 * | 9/2005 | Le et al. | 126/339 |
| 6,976,596 | B2 | 12/2005 | Brooks | |
| 6,976,597 | B2 * | 12/2005 | Jahrling et al. | 211/175 |
| 7,087,862 | B1 | 8/2006 | Shaffer et al. | |
| 7,431,410 | B2 * | 10/2008 | Sato et al. | 312/333 |
| 2003/0006682 | A1 | 1/2003 | Hoffman | |
| 2006/0017359 | A1 | 1/2006 | Sato et al. | |

* cited by examiner

*Primary Examiner* — Hanh V Tran
(74) *Attorney, Agent, or Firm* — Enrique J. Mora; Beusse Wolter Sanks Mora & Maire, P.A.

(57) ABSTRACT

A slide system for an appliance is provided. The system may be used with a retractable compartment, such as a drawer, shelf or grill and may be implemented inside a cavity of the appliance having a pair of vertical walls provided with a series of ribs having a recess at their top surfaces, and a movable runner in the recess. The runner may be located over slides that delimit and guide travel of the runner to provide a longer draw-out distance for the retractable compartment, which is conducive to improving storage ability and accessibility to the retractable compartment.

8 Claims, 20 Drawing Sheets

22
14
28
15
17
46
16

22
17
14
15
46
16
28

33
34
32
36
31
37
30

34
32
38
31
35
33

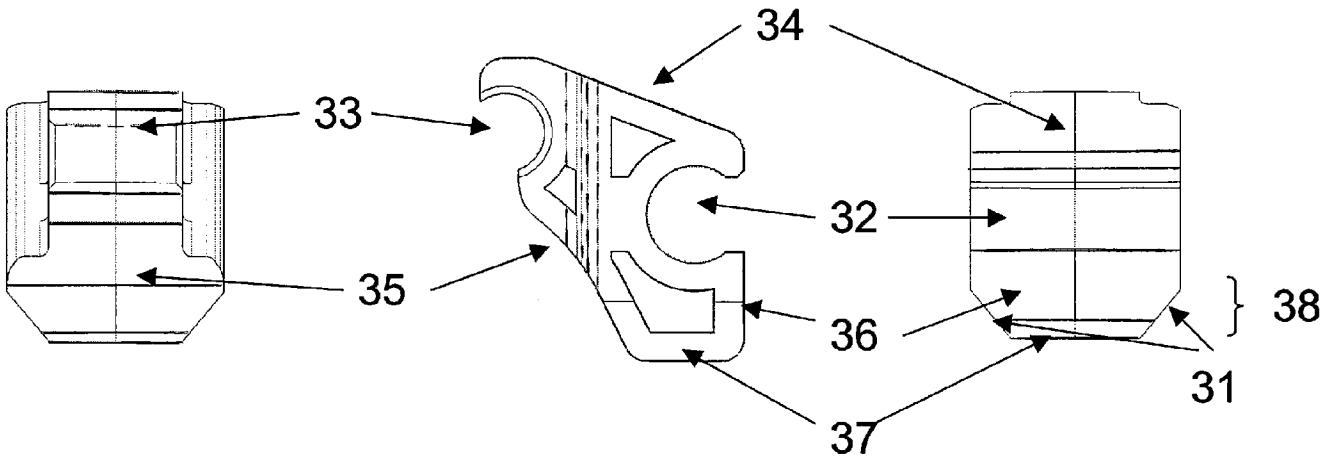
Fig 18
Fig 17
Fig 16
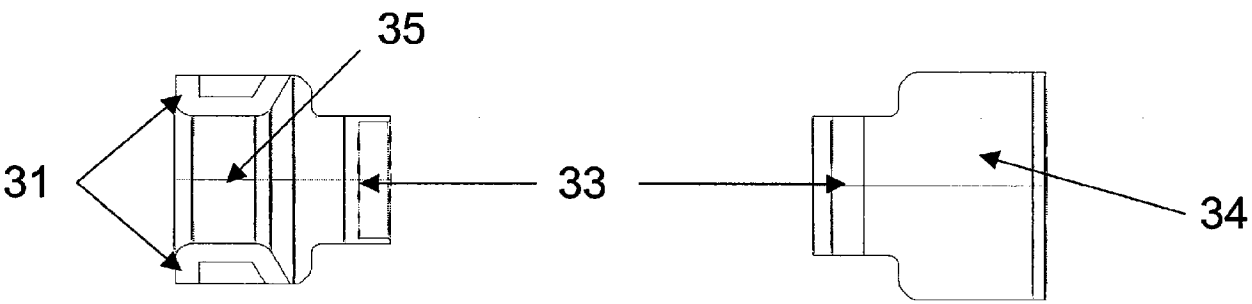
Fig 20
Fig 19

SLIDE SYSTEM FOR DRAWERS OR SHELVES IN AN APPLIANCE

RELATED APPLICATIONS

This application claims priority from Mexican application Serial No. MX/a/2007/008018 filed Jun. 28, 2007, which is incorporated herein by reference in its entirety.

FIELD OF THE INVENTION

The present invention is generally directed to the field of appliances that include retractable compartments, such as shelves, racks, grills, or drawers, and devices that require a reciprocating rectilinear drawing (pull) or insertion (push) motion in operation.

BRIEF SUMMARY OF THE INVENTION

Aspects of the present invention allow for an incremental extension upon drawing retractable compartments, such as shelves, racks, grills or drawers, e.g., an extra drawn-out distance allowing improved reach to objects or items placed on shelves, racks, grills, or drawers. Most users would find desirable to have an extra drawing extension, especially if bulky objects or items are to be placed in a drawer or over a rack.

For example, let's think in a shelved cabinet that has a pair of folding doors on a vertical axis, and in a bulky object, which is to be deposited inside said cabinet. Normally the user would pull out the shelf towards him/her to deposit the bulky object, afterwards he/she would simply push the shelf inside the cabinet. Likewise, if we think in a cabinet with drawers, this same action may be a bit more complicated. Between shelves there is always a gap that allows access to the items placed on them, but in the case of drawers the access to their contents is usually obstructed by another drawer or a covering above it that also gets in the way when depositing objects, especially if they are bulky.

To gain complete access to the inside of a drawer and to avoid a partial obstruction limiting the volume of the object to be deposited inside the drawer, a fully drawn extension of the drawer is required. If the bulky object cannot be placed inside the drawer because it cannot be travel to be drawn out a sufficient total distance, the user may have to do the following: completely pull out the drawer, place the object inside, lift the drawer with the added weight of the bulky object, and attempt to reinsert the drawer into the cabinet. This invention provides a low cost solution to this problem, with a reduced number of parts which are durable and easy to manufacture, and which may work in low temperature environments such as freezers, or high temperature settings such as inside an oven.

By way of example, it is contemplated that features of the present invention will be substantially useful in domestic refrigerators, for both fresh food and freezer compartments. For example, there are several types of refrigerators in the market, for descriptive purposes we refer to a duplex or "side by side" refrigerator, characterized by having the fresh food compartment beside the freezer, separated by an thermal-insulating wall known as "mullion".

Each compartment may have separate doors. Due to design and practical reasons, the freezer is narrower than the fresh food compartment, and its available space must be optimized at all times because it usually takes in frozen packaged products that need to be kept at low temperatures for long term conservation. Having a drawer which draws out horizontally allowing exposition of most of its contents without being obstructed by a shelf, lid or other drawer, would make the extraction of bulky and heavy packages easier and faster for evident reasons, and solve the problem set out above in the background section. Such a drawer has a pair of slides, preferably manufactured with two parallel rods, mounted on its lateral sides, which preferably are longer than the front and backsides. The travel distance of these slides depends on the length of the drawer, of the bearing brackets or ribs on the refrigerator wall that support the drawer, and the normal travel distance of the drawer; these features determine the safe extra travel distance since the weight and the cantilevered position of the drawer increases the load stress at the weight-bearing points, which can easily be overloaded causing some part of the mechanism to give way, leading to the collapse of the drawer.

Each slide houses a runner that travels inside the recess of the upper rib of the liner, so when the drawer is drawn out the runner reaches the limit of its travel path that is limited by the dimensions of said liner recess. When the runner reaches said limit, the runner allows the parallel slide to glide over it enabling an extra traveling distance, which extends the length the drawer can be drawn out.

Other example appliance that may benefit from aspects of the present invention may be the oven of a domestic stove. An oven has a cavity similar to that of a refrigerator, but generally tending to a square shape, that is, its width and height are almost equal. These oven cavities have a pair of lateral walls having bearing ribs that support the oven grills. These grills are racks made of rigid steel wire in a rectangular shape, whose frame is usually made from the same material and houses a series of straight wires evenly spaced to support the objects placed on the rack. This is a convenient design feature because it allows the free flow of air through the grill to surround the object placed thereon. Typically, the object is very hot when its time to extract it from the oven, thus requiring that the grill be pulled out as far as possible from the cavity of the oven, to allow a better handling of the hot object.

There arises the need for a mechanism made of few high temperature resistant pieces and easy to manufacture, which allows the grill to travel an extra distance so it may be completely pulled out from the oven's cavity and permit a safe placement of the items to be cooked inside de oven, without the risk of having the rack collapse, which may injure the user and damage the oven. Therefore, a grill with a pair of parallel slides at its rear lateral ends was conceived, with each slide having a runner traveling over it. This runner can travel a set distance over the recess of the bearing ribs. Once the slide reach the end of their travel when the grill is pulled out, the parallel runners are allowed to glide over the slides all the way of the travel distance, which is the extra length the grill can be pulled out.

BRIEF DESCRIPTION OF THE DRAWINGS

Figure Description

DETAILED DESCRIPTION OF THE INVENTION

Figure 1:
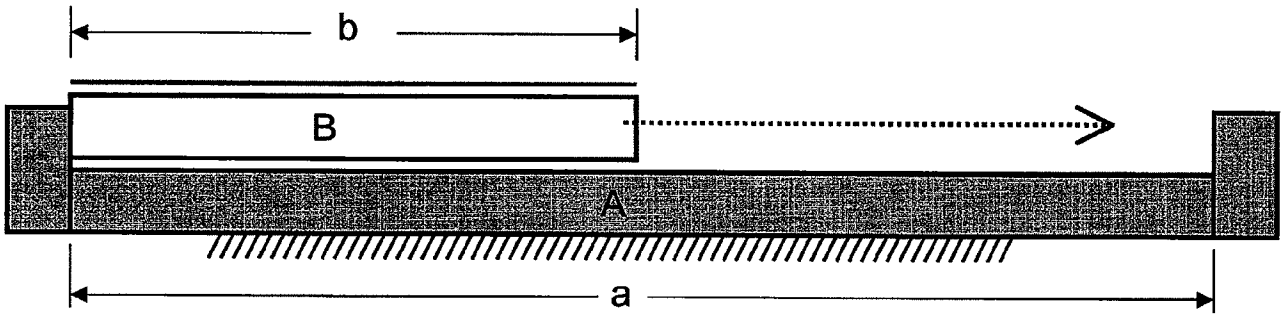
Fig 1 PRIOR ART
FIG. 1 Layout scheme of traditional slides
Figure 1A:
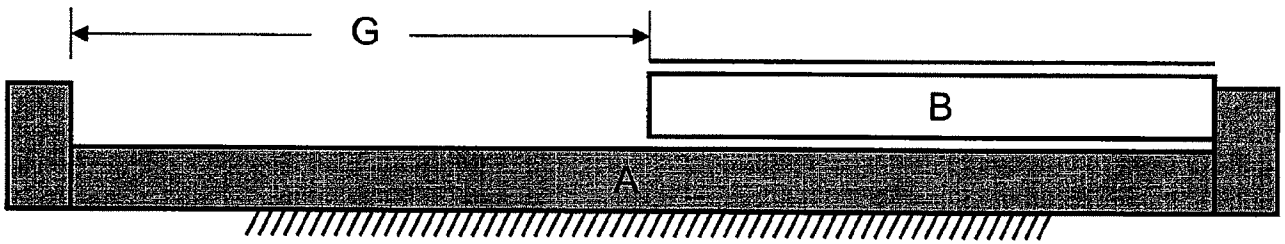
Fig 1a PRIOR ART
FIG. 1*a* Layout scheme of traditional slides

There are several types of slides for drawers or racks/grills in general. Due to the diversity of mechanisms available in the market and for study purposes, we have classified them in six main groups. FIGS. 1 and 1*a* show a basic slide and drawer system where the slide A houses the sliding object B; as these figures show, the useful area b is defined by the load area of the sliding object B which for practical purposes is the same as b at any given moment. The slide A requires a travel distance at least greater than b so the sliding object B can glide over it, the desirable distance being at least two times b. The extension or opening travel distance G equals b and is defined at any given moment by the equation G=a−b.

Figure 2:
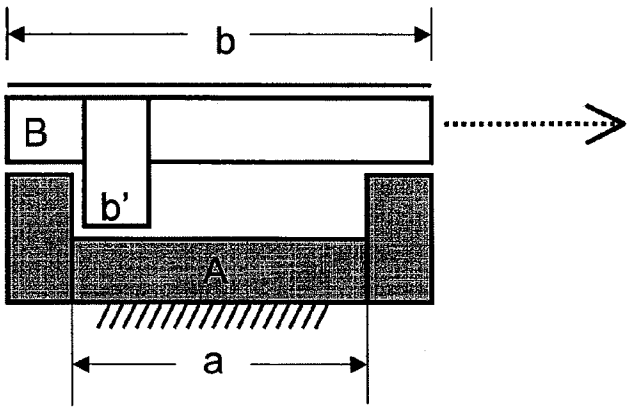
Fig 2 PRIOR ART
FIG. 2 Travel distance of a typical drawer
Figure 2A:
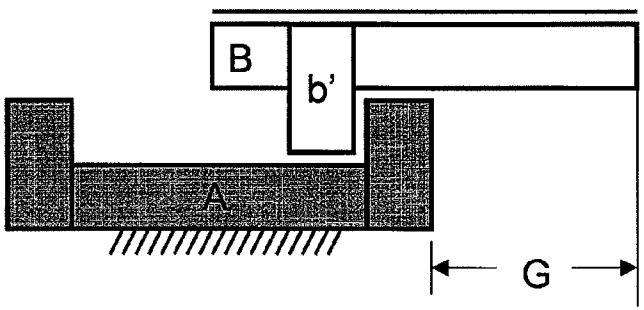
Fig 2a PRIOR ART
FIG. 2*a* Travel distance of a typical drawer

FIGS. 2 and 2*a* show a typical drawer mechanism. A is the slide delimited on its lateral sides by a pair of stops or bulges, that will limit the travel of the sliding object B which in this case is fitted with an appendix b' fixed to the structure of the sliding object B and that travels within the limits set in A. FIG. 2 shows the mechanism at a standstill position, the useful area b is almost equal to the surface of the sliding object B. In this position no item can be introduced into or deposited over the sliding object B, so FIG. 2*a* shows the sliding object B drawn out and allowing us to discern how b' glides over the slide A up to its opposite end and produces an extension or opening travel distance G defined at any given moment by the equation G=a−b'. As FIGS. 2 and 2*a* and the above equation show, the useful area b is not equal to G. This is not desirable when bulky or inflexible objects are to be deposited in the drawer, because a useful loading area or volume is wasted.

Figure 3:
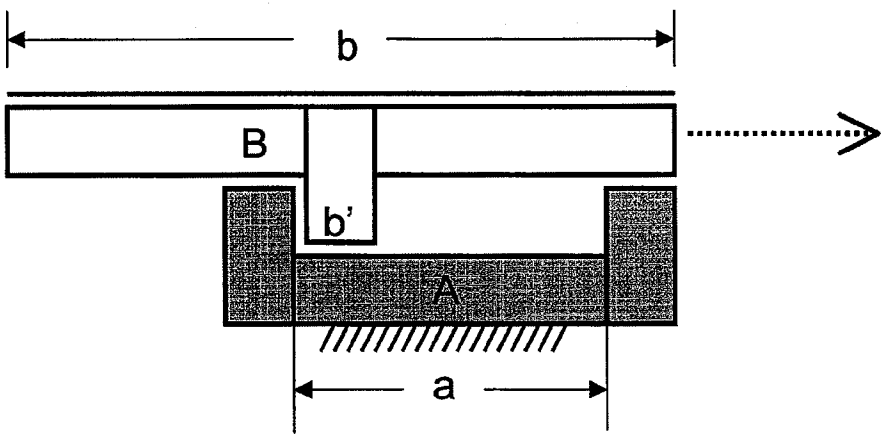
Fig 3 PRIOR ART
FIG. 3 Travel distance of drawer chest where the drawer is longer than the slide FIG. 3*a* Travel distance of drawer chest where the drawer is longer than the slide FIG. 4 Travel distance of telescopic drawer system FIG. 4*a* Travel distance of telescopic drawer system FIG. 5 First combination of slide system with drawer at standstill position FIG. 5*a* First combination of slide system with drawer drawn half-way FIG. 5*b* First combination of slide system with fully pulled out drawer FIG. 6 Isometric view of drawer with conventional slide and the drawer in the closed position FIG. 6*a* Isometric view of drawer with conventional slide and the drawer in the pulled out FIG. 7 Front isometric view of a refrigerator liner with drawers FIG. 8 Detail of isometric front view of the refrigerator with drawers FIG. 9 Left side view of the refrigerator without right liner FIG. 10 Left side isometric view of the refrigerator without right liner FIG. 11 Left side view of the refrigerator without right liner where the drawers can be seen completely inserted FIG. 12 Isometric detail of liner ribs FIG. 13 Left side isometric view showing the drawer and the liner ribs FIG. 14 Isometric front view of the runner FIG. 15 Isometric front view of the runner FIG. 16 Left side view of the runner FIG. 17 Front view of the runner FIG. 18 Right side view of the runner FIG. 19 Bottom view FIG. 20 Top view FIG. 21 Isometric detail of the runner slide system FIG. 22 Isometric detail of the runner slide system with the runner at standstill position FIG. 23 Isometric detail of the runner slide system with the runner in the drawn out position FIG. 24 Left side view showing different positions of the drawers FIG. 25 Left side isometric view showing a pulled out drawer and a drawer at standstill position FIG. 26 Left side isometric view of the drawer with a rod on the rib of the liner and the drawer in closed position FIG. 26*a* Left side isometric view of the drawer with a rod on the rib of the liner and the drawer in the pulled out position FIG. 27 Left side isometric view of the drawer with the rack bar and pinion system, and drawer in the closed position FIG. 27*a* Left side isometric view of the drawer with the rack bars and pinion system, and the drawer in the pulled out position
Figure 3A:
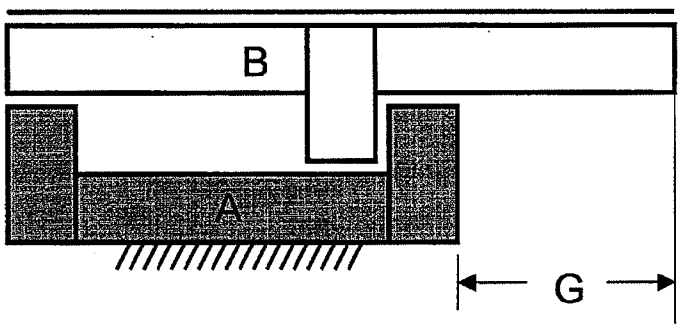
Fig 3a PRIOR ART

FIGS. 3 and 3*a* are a variation of the mechanism shown in FIGS. 2 and 2*a*. The main difference is that the travel distance "a" is smaller than the useful area "b" while in FIGS. 2 and 2*a* "a" and "b" are equal.

Figure 4:
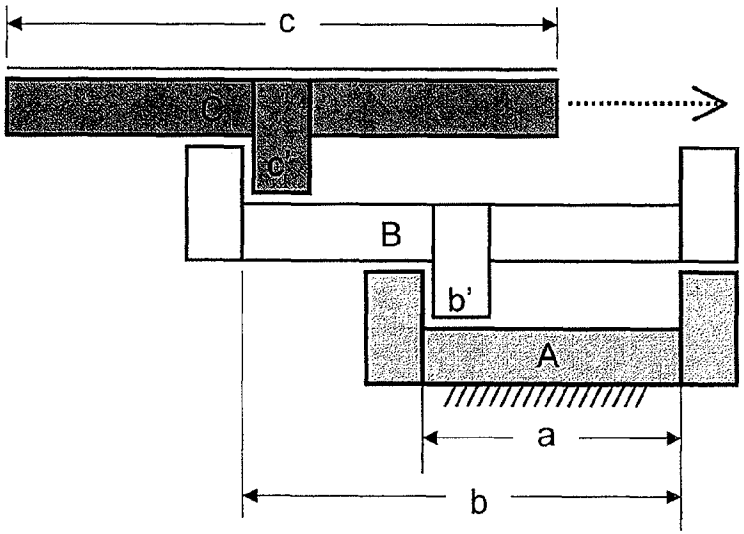
Fig 4 PRIOR ART
Figure 4A:
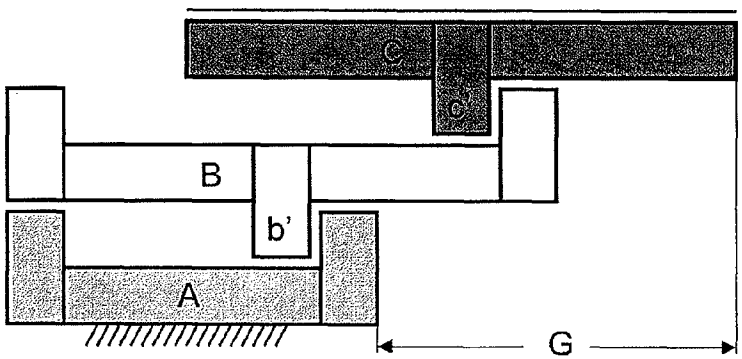
Fig. 4a PRIOR ART

FIGS. 4 and 4*a* show an example telescopic mechanism with at least two sets of slides. This mechanism is of interest because it can produce a extension or opening travel distance "G" greater than in the above examples. Slide "A" is overlapped by slide "B" which also has an appendix "b'" which travels the distance "aa". Slide "B" is overlapped by the sliding object "C" which also has an appendix "c'" attached thereto which travels the distance "b" to produce a extension or opening travel distance G defined by the equation G=a−b'+b−c'; considering that appendixes b' and c' are of equal size, then G=a+b−2*c*'. As FIG. 4*a* shows, the useful area c is closer in size to the sliding object "C", providing a greater extension or opening travel distance of sliding object "C" from its standstill position.

Figures 5, 5A, 5B:
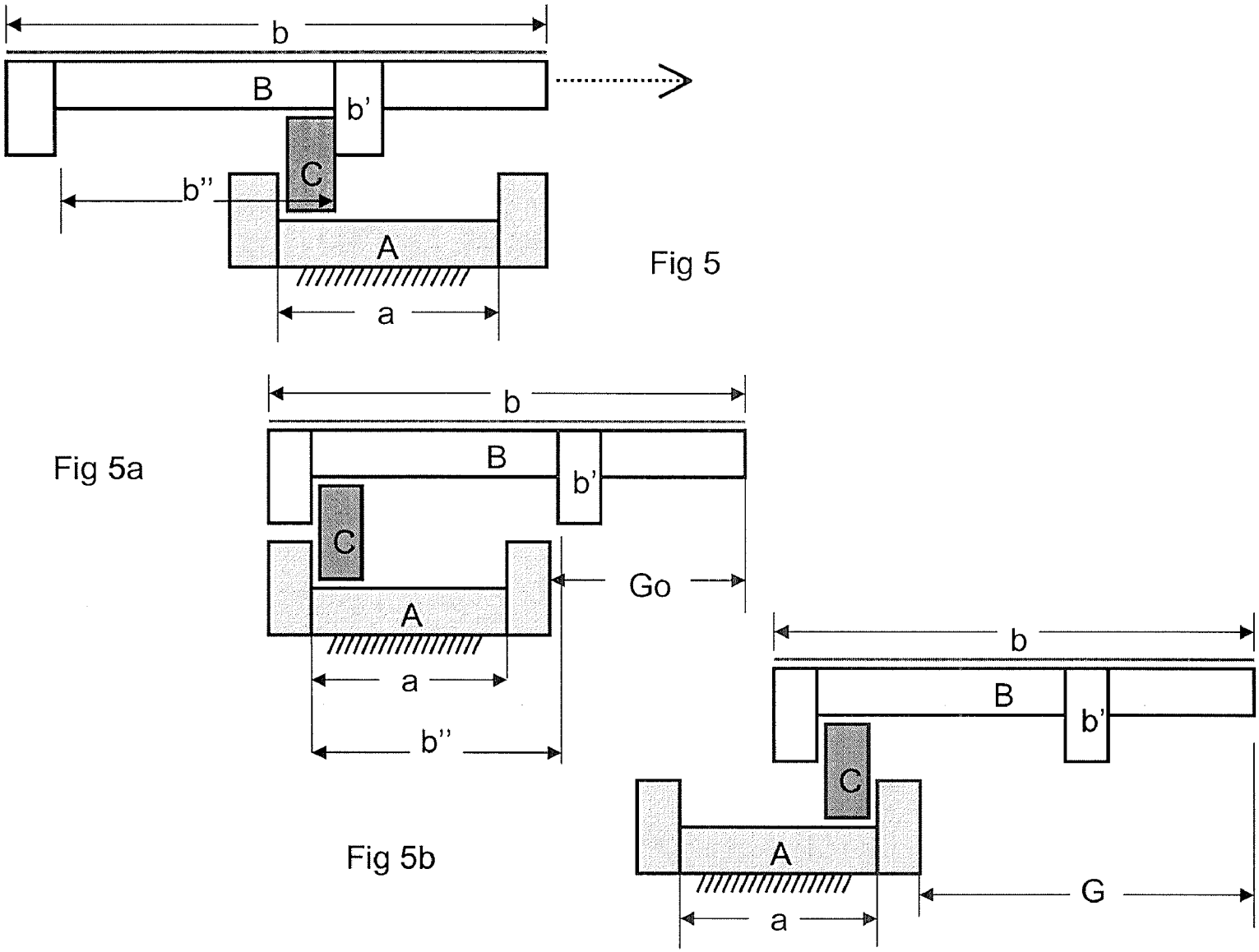

FIGS. 5, 5*a* and 5*b* show a combination of example slide systems used in accordance with aspects of the present invention. Slide "A" with a distance "a" is overlapped by the sliding object "C" which can be a runner that can glide horizontally within two combined paths determined by the dimensions "a" and b". When the sliding object "B" glides horizontally it travels over the distance b" which makes the opening "Go" equal to b". As the sliding object "B" continues to be pulled out because the travel over dimension "a" is still possible as shown in FIG. 5*b*, the total extension or opening travel distance "G" is defined by the equation G=a+b−2C. This produces almost the complete extraction of the useful area "b" leaving a covered and inaccessible dimension "2C" which for practical purposes is very small.

Aspects of present invention may be suitable for the design of drawers for "duplex" or "side-by-side" refrigerators, therefore, the description of the invention will refer to such devices. It will be understood, however, that the present invention can be implemented in any type of cabinet or cavity, not limited to a refrigerator drawer, it can also be adapted to a grill or rack, one difference difference being that the dimension representing the depth of a drawer is absent or small in the case of a grill or rack.

Figures 6, 6A:
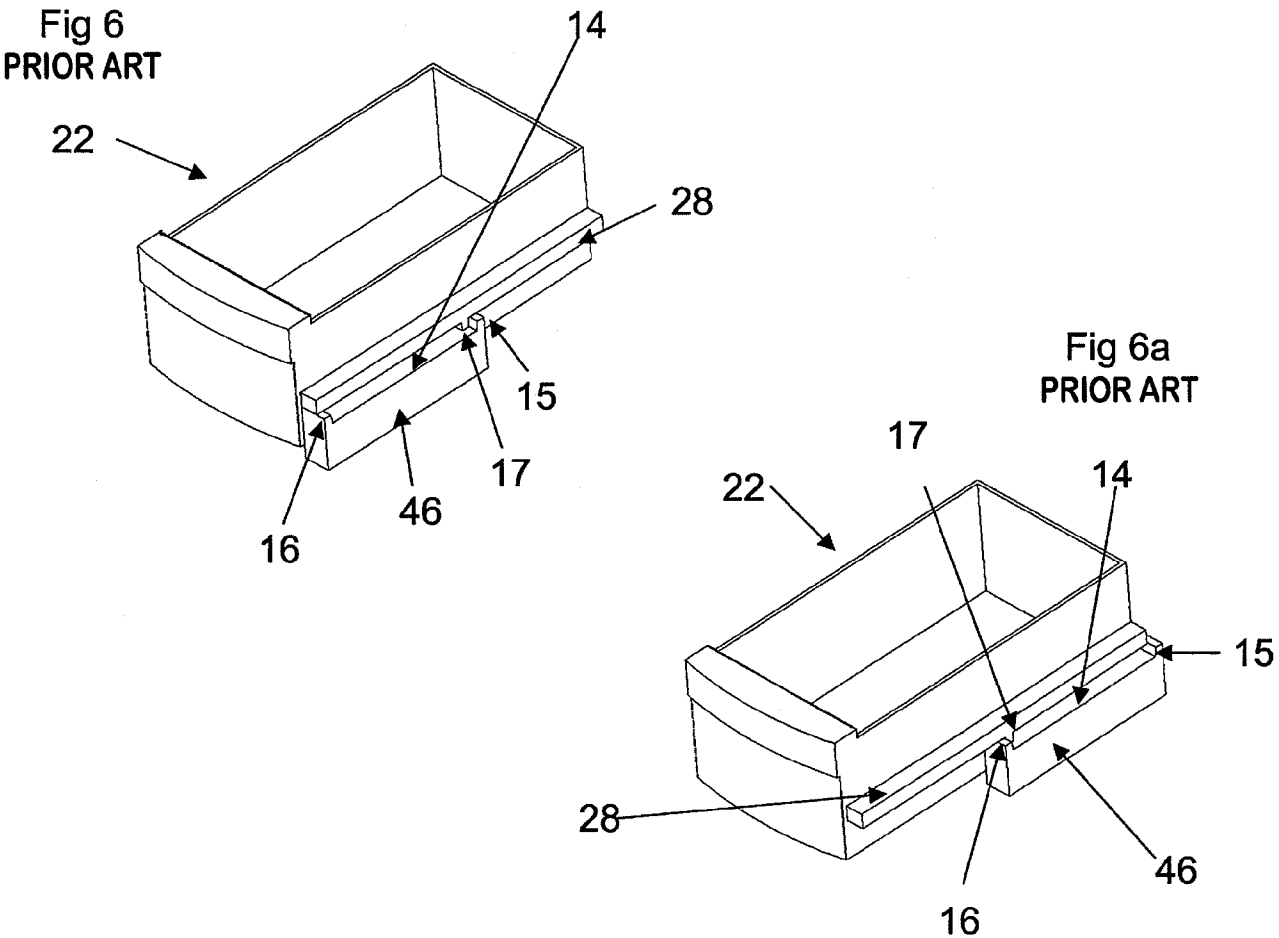
Fig 6 PRIOR ART
Fig 6a PRIOR ART

Bearing in mind the foregoing considerations, the freezer compartment of a "duplex" or "side-by-side" refrigerator will be an example environment to describe an example embodiment of the invention. FIGS. 6 and 6*a* show the traditional shortcomings of a refrigerator drawer. Said drawer 22 has a pair of brackets 28 which horizontally protrude from its lateral sides. Said brackets 28 extend across the length of drawer 22 and at some longitudinal point they have a fixed stop 17. Said fixed stop 17 travels forwards and backwards inside recess 14, and its travel is limited by stops 16 and 15, respectively. As shown in FIGS. 2, 2*a*, 3, and 3*a*, which are an schematic representation of the mechanism described by FIGS. 6 and 6*a*, the draw-out distance of the drawer at all times depends on the length of recess 14, which limits the draw-out distance of drawer 22 due to design limitations, such as the inability to modify the geometry of liner 10, which would entail higher development and costs. Other design consideration is the available space, which needs to be fully usable in account of the needs of the user. There is a need to maximize the distance the drawer 22 can be pulled out to allow placing objects and packages of considerable size. FIGS. 2, 2*a*, 3, and 3*a* show a typical slide mechanism for drawer 22 that consists of a slide "A" overlapped by the sliding object "B" having an appendix b' that prevents reaching the maximum draw-out distance "G". It is to be noted that slide "A" acts sometimes as the recess 14, as shown in FIGS. 6 and 6*a*, and this limits the dimensions of both the slide "A" and the recess 14 to less than the length of the drawer 22; this makes possible to draw out the drawer 22 almost its entire length, which would be ideal in terms of FIGS. 2 and 2*a* as the maximum draw-out distance "G" should be as close as possible to dimension b.

Figure 7:
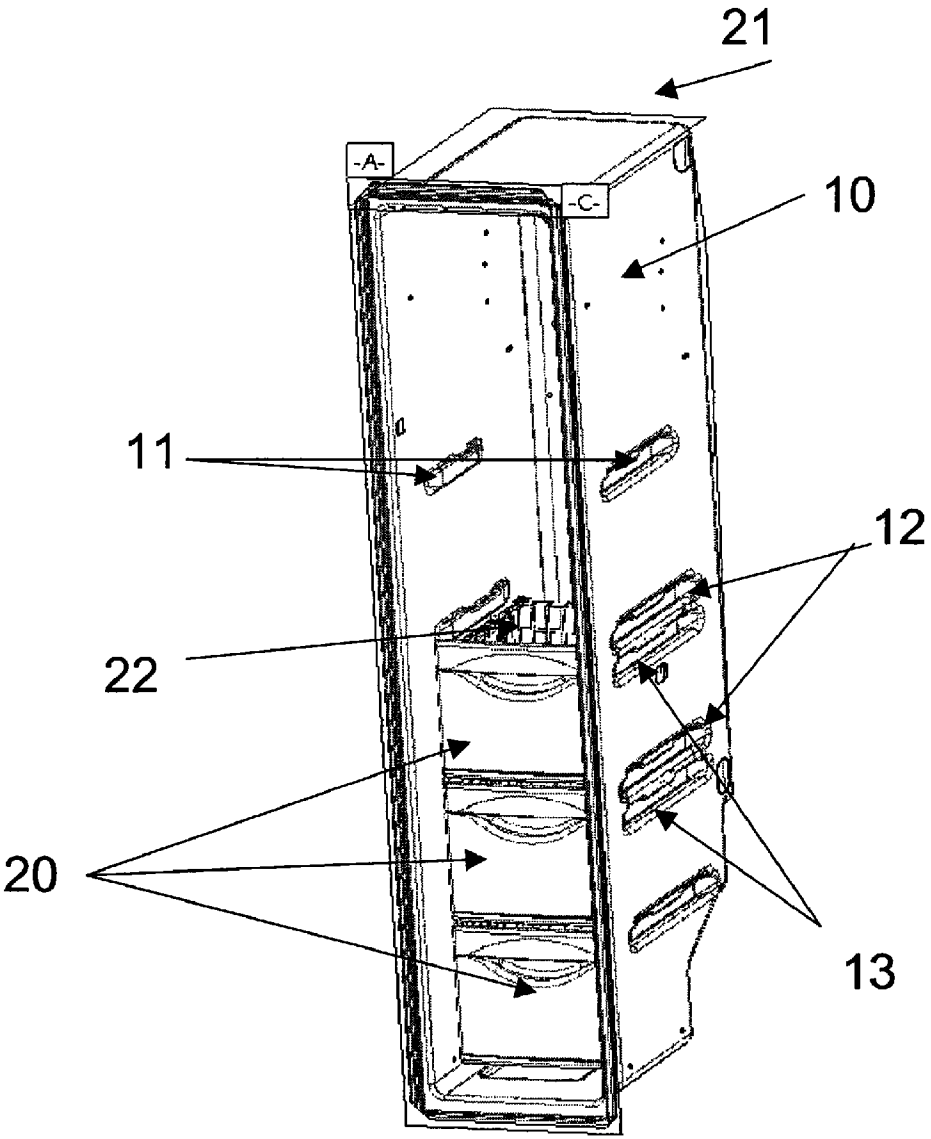

FIG. 7 shows an isometric view of the cavity of the freezer compartment of a "duplex" or "side-by-side" refrigerator; said cavity is manufactured of some thermoformed plastic and is called a liner 10. Said liner 10 houses the drawers 22 (not shown) which are fitted with a faceplate 20. A series of ribs 11, 12, and 13 are embossed in the vertical lateral walls of liner 10 so the basket frame 27 can slide over them and be pulled out. In a standstill position said ribs 11, 12, and 13 bear the weight of the drawer 22 and its contents.

Figure 8:
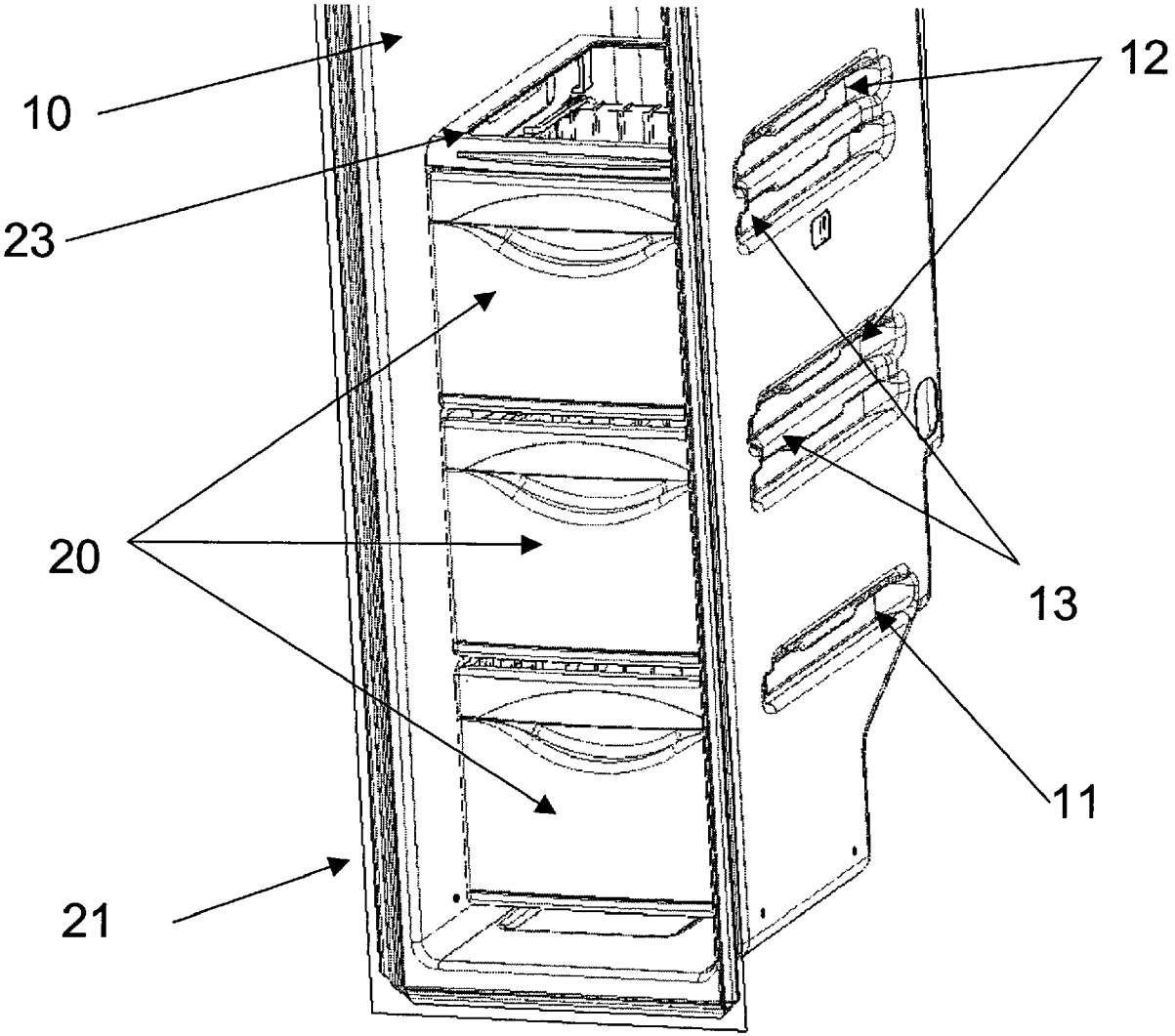

FIG. 8 shows a detail of the arrangement of the drawers 22 inside the bottom part of the freezer cavity; the arrangement of the ribs 11, 12, and 13, and the upper shelf 23 which sometimes is also the lid for the upper drawer 22.

Figures 9, 10:
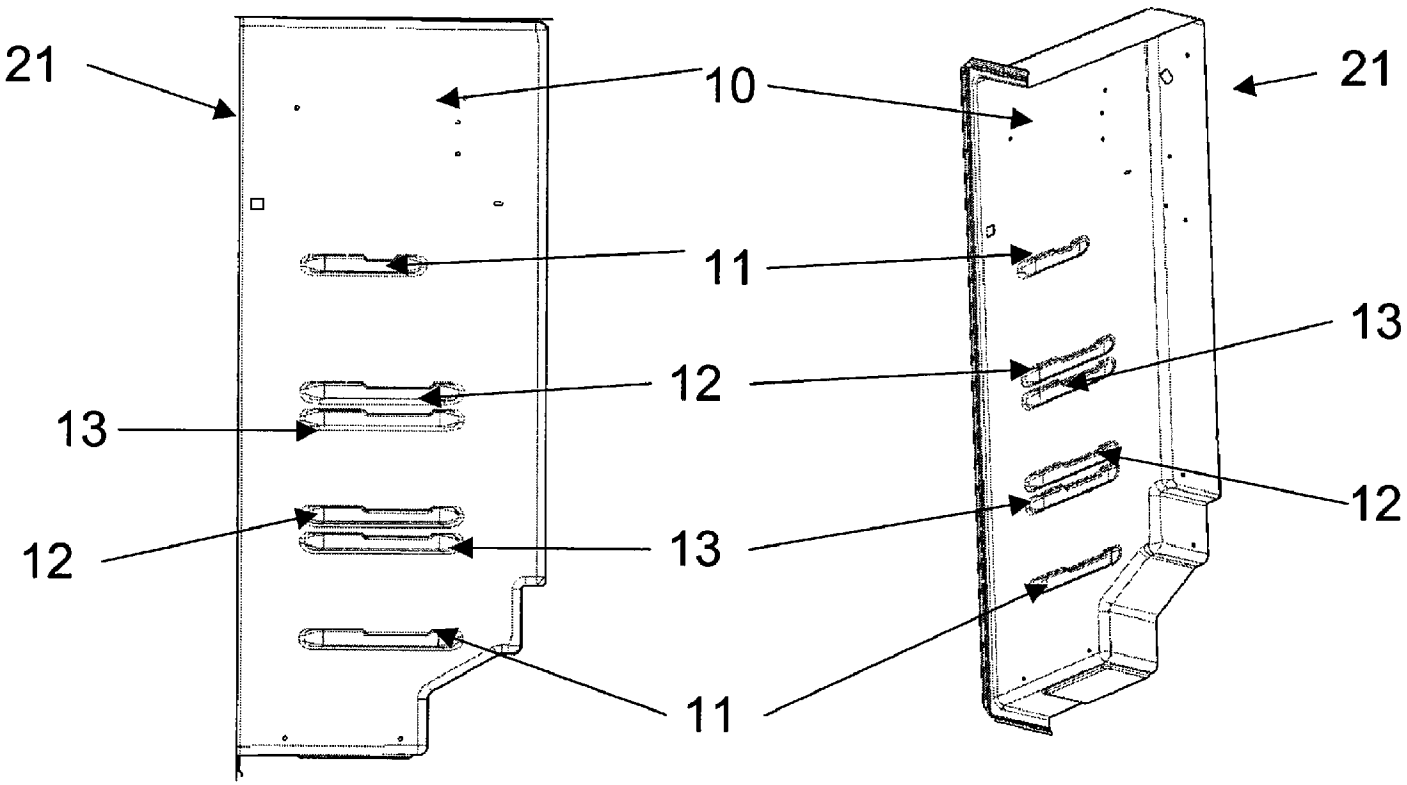

FIGS. 9 and 10 show a left cross-sectional view and a isometric view of said cross-section, respectively, of the freezer cavity 21 showing a vertical wall of the liner 10 with ribs 11, 12, and 13 and their spatial location inside the freezer cavity 21. Said location is determined by design parameters and by the dimensions of the drawers 22, the ease of opening and reach of the users, as well as the habits of the users, which in some way define the size of the drawer for storing products the user acquires and require freezing. It is evident that any modification to the ribs 11, 12, and 13, and the liner 10 itself entails a considerable investment in design, structural tests, tooling, etc., therefore any modification of said ribs 11, 12, and 13 and the liner 10 is not desirable. The present invention discloses a slide system that do not imply any modifications to the structure of the liner 10 and the ribs 11, 12 and 13, by providing the drawer 22 with a longer travel distance upon opening.

Figure 11:
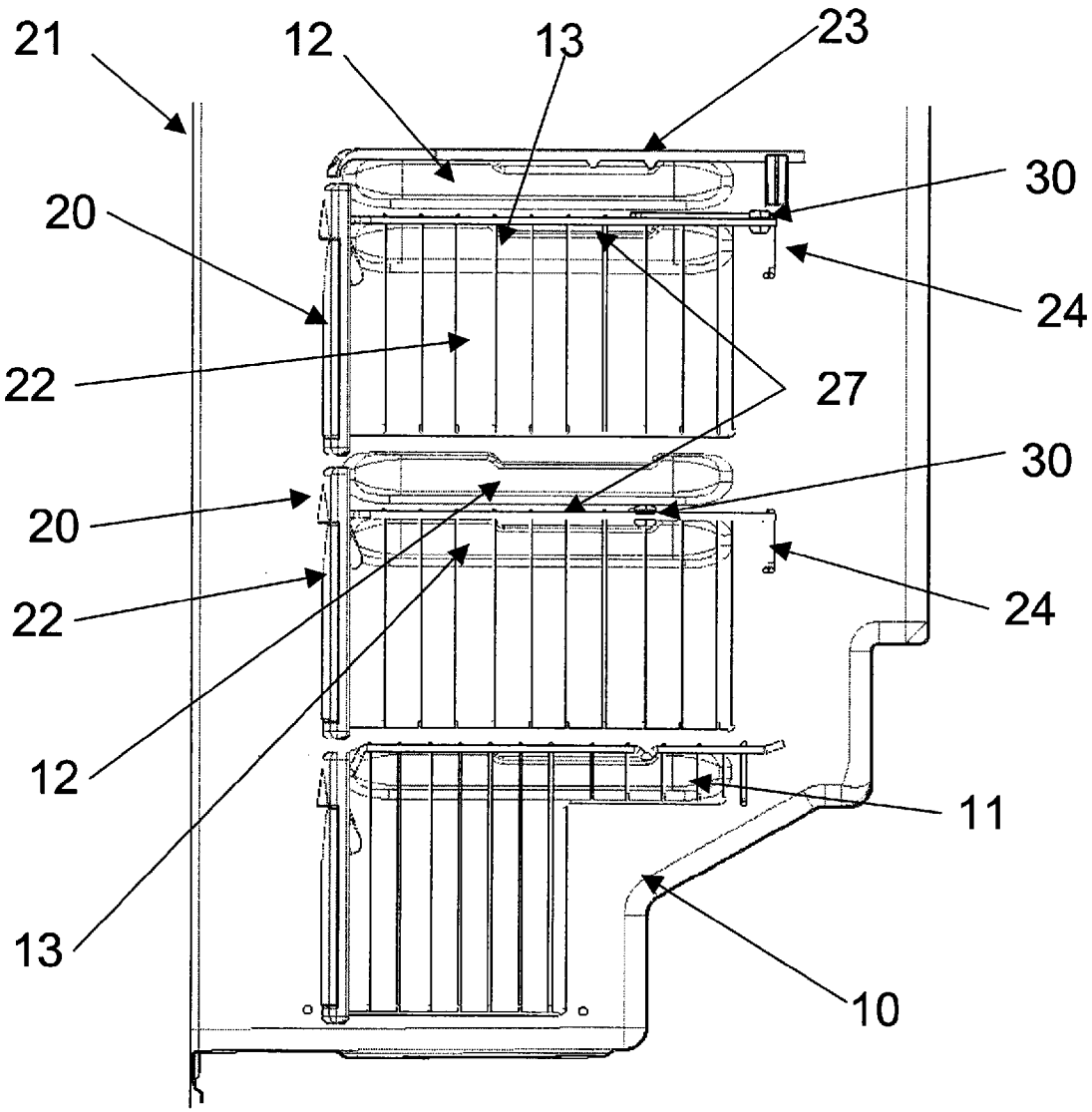

FIG. 11 shows a lateral view of the cavity of the freezer 21 having one of the vertical walls of liner 10 removed, allowing a view of the interior. This figure shows the space occupied by the drawers 22, which may be manufactured with wire mesh, to facilitate the passage of cold air to better cool the objects contained in the drawer 22. This structural feature is not meant to be limiting since it does not preclude that said drawer may be built of different materials such as plastic or metal, either with solid, perforated or slotted walls, but to better illustrate the operation of the present invention the drawers 22 may be manufactured with wire mesh. The figure also shows frame 27 placed over rib 13, however, the user may opt to place it over rib 12 if he/she prefers to modify the placement height of drawers 22 inside the cavity of the freezer 21. Also shown are the runners 30 that glide over the slides 25 and 26 (not shown) and the location of the C-guide 24 in the backside of the drawer 22, the C-guide 24 clings to the rib 13 (or rib 12 depending on the location of the drawer 22) when the drawer 22 is pulled out, thereby stopping the drawer from falling down due to the weight of its contents by leaning the bottom part of the C-guide 24 on the bottom side of the rib 13 (or rib 12 if applicable). The front side of the drawer 22 consists in a faceplate 20, which aesthetically enhances the appearance of the cavity of the freezer 21, however, in terms of functionality the drawer 22 can do without this faceplate and be replaced with wire mesh or a wall.

Figure 12:
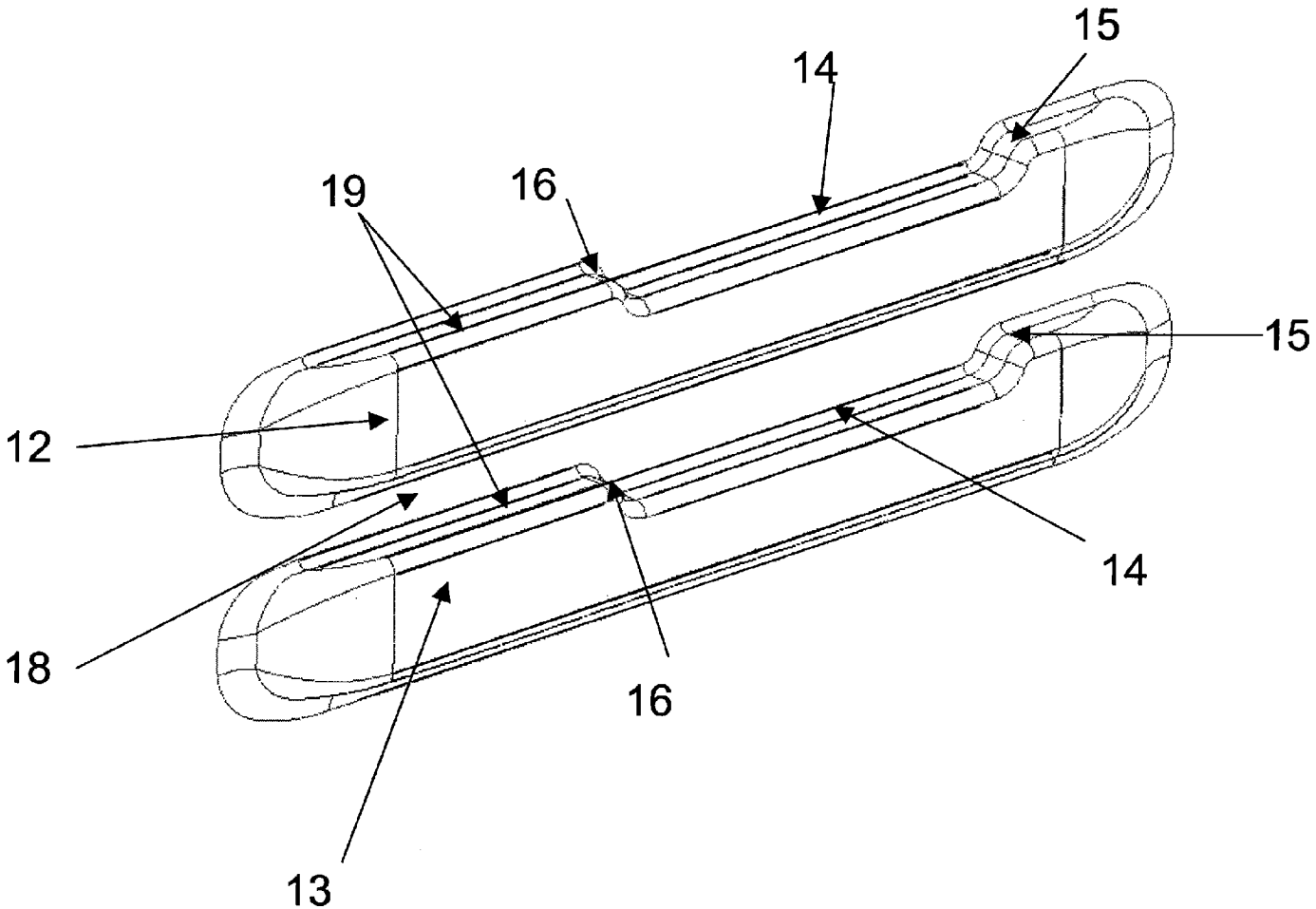

FIG. 12 shows a detail of the ribs 12 and 13; said ribs 12 and 13 consist of a recess 14 delimited by a pair of stops 16 and 15 at the front and the back, respectively. Also shown is the upper side acting as a loading surface 19, which is in contact with the basket frame 27 and bears its weight allowing it to slide in a reciprocating movement forward and backwards. The recess 14 houses the runner 30 while it moves, and limits its travel distance. The ribs 12 and 13 form a channel 18, which allows a supplementary draw-out distance by allowing the runner 30 to fit between the three walls formed by the bottom side of the rib 12, the wall of liner 10, and the loading surface 19 of the rib 13; the runner makes contact with these three walls at the first inclined plane 34, the vertical plane 36 and the horizontal plane 37, respectively, thanks to the adequate camber 38 the runner can occupy the space of the recess 14 and get inside the channel 18. For the runner 30 to get into the channel 18 there should be an adequate coupling angle 31 ranging from 15 to 65 degrees, allowing it to jump over stop 16 when the user pulls out the drawer 22.

Figure 13:
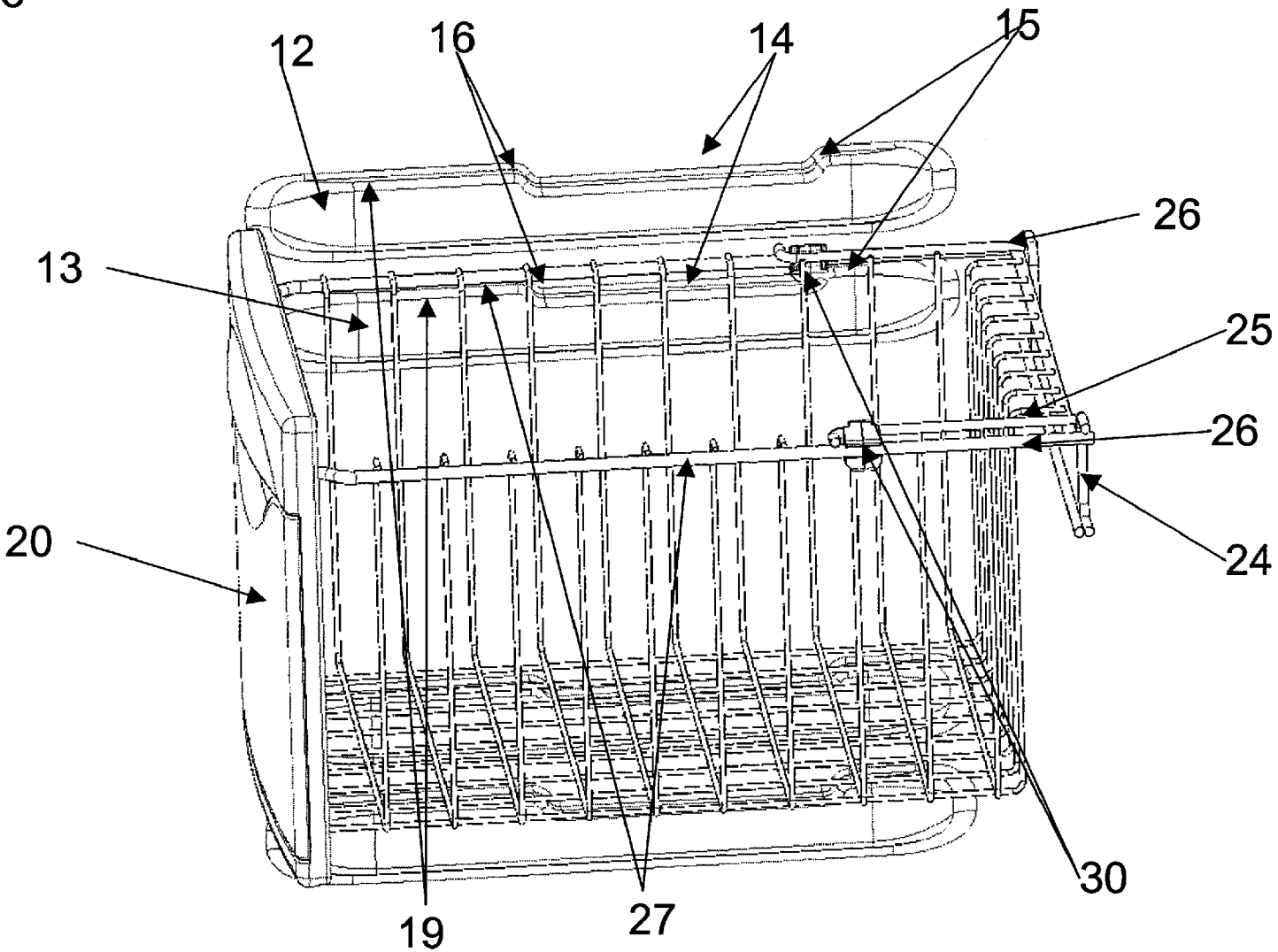
Figures 14, 15:
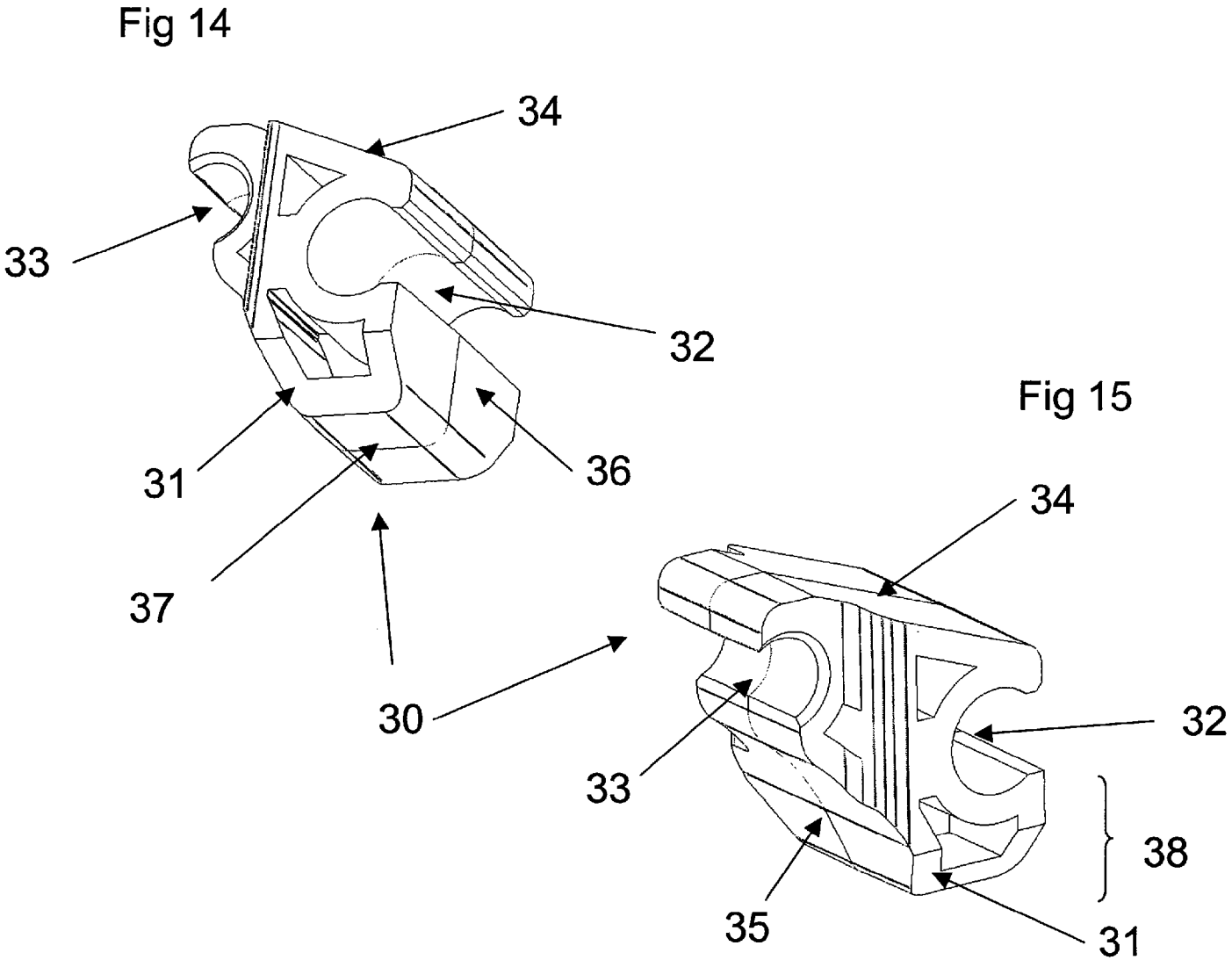

FIG. 13 shows the drawer 22 at standstill position, that is, completely inside the cavity of the freezer 21. The frame 27 is supported by the loading surface 19 of the rib 13. Notice the location of the runners 30, the slides 25 and 26 in the backside of the lateral sides of the frame 27, ending just where the C-guide 24 is located.

FIGS. 14, 15, 16, 17, 18, 19, and 20 show the different components of the runner 30. Said parts are the C-rail 32 connected to the bottom slide 26 to glide over it. Considering that said bottom slide 26 is a round rod, the runner 30 would tend to rotate, to prevent this a C-rail 32 was devised, thereby allowing only a horizontal rectilinear movement over the slides (a single freedom degree movement). The camber 38 is sized to fit the space formed by the recess 14 of the ribs 12 or 13, as well as to fit in the C-channel 18 formed by said ribs 12 and 13. Said camber also consists of a pair of coupling angles 31, which make contact with the stops 16 and 15 at the end of the travel of recess 14; the second inclined plane allows the runner 30 to fit between the slides 25 and 26.

Figure 21:
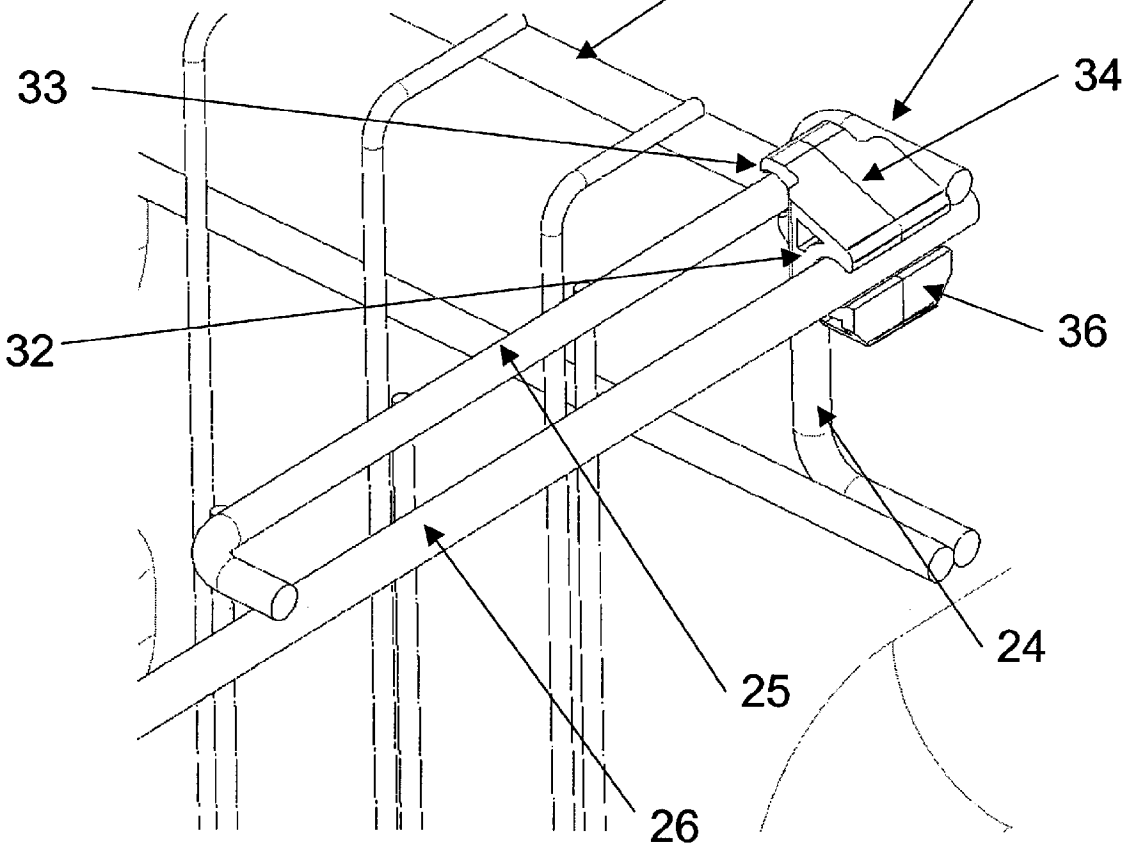

FIG. 21 shows the assembly of the runner 30 in the slides 26 and 25, the C-rail 32 houses the bottom slide 26 allowing the runner to glide over. To prevent the rotation of runner 30 around the longitudinal axis of the bottom slide 26, the runner 30 is provided with a guiding slot 33 that is connected with the upper slide 25; this also puts the camber 38, vertical plane 36, and horizontal plane 37 in an adequate position to interact with the recess 14 of the ribs 12 or 13. Meanwhile, the C-guide 24 clings to either the rib 12 or rib 13 (depending on the position), preventing the drawer from falling down while being pulled out.

Figures 22, 23:
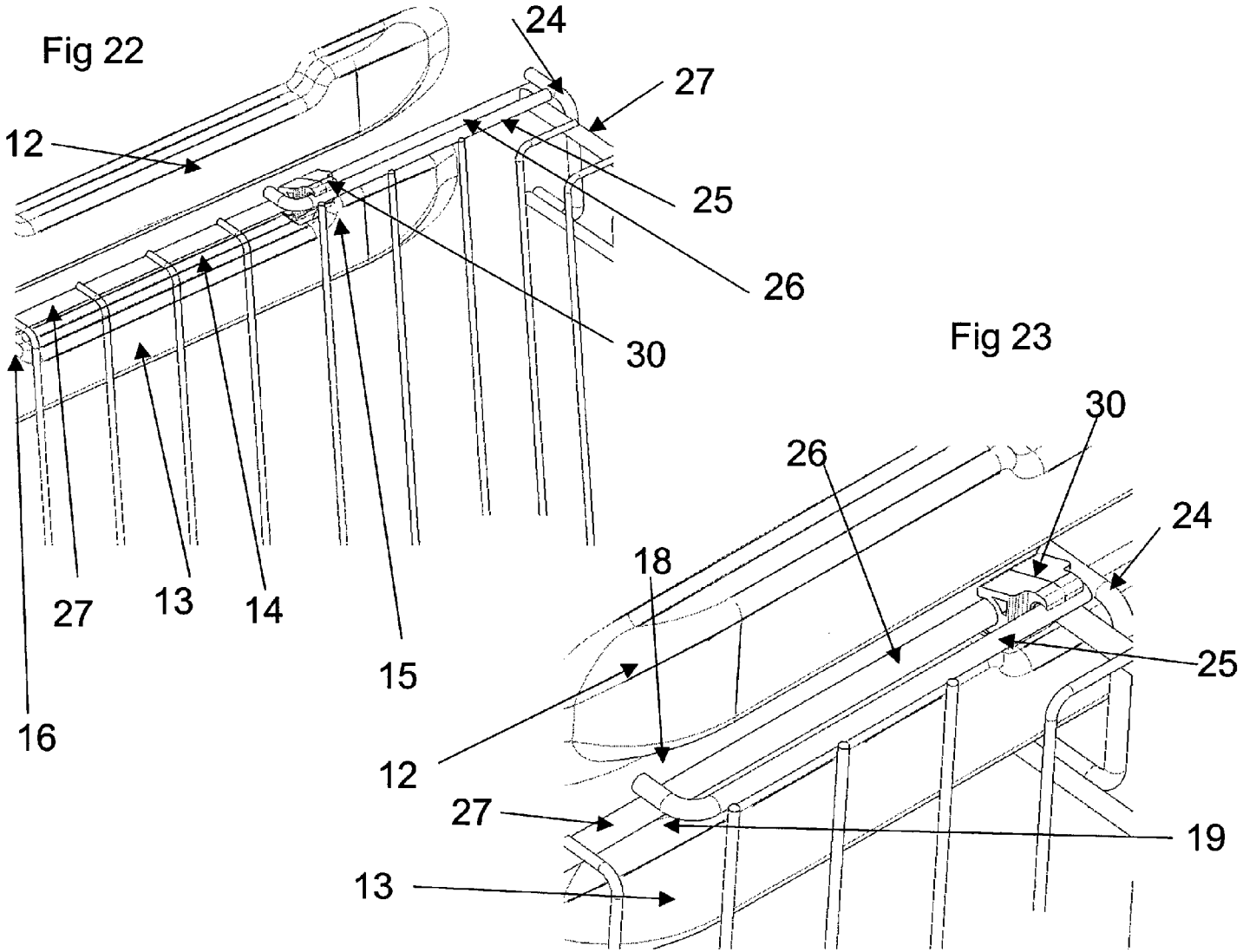

FIGS. 22 and 23 show the interaction of the runner 30, slides 25 and 26, and the frame 27 with the ribs 12 and 13. FIG. 22 in particular shows the drawer at standstill position. In this position the C-guide is not in use, that is, is not in contact with either one of the ribs 12 or 13. The runner 30 is also at standstill position, placed between the back stop 15 and the travel end curve of the upper slide 25. FIG. 23 shows the drawer 22 in a completely pulled out position, so the runner 30 is located between the front stop 16 and the frame 27, however, if the drawer 22 is further pulled out the runner 30 gets into the channel 18, thereby producing an extra length of the opening distance. Also noteworthy is the C-guide 24 which clings to the rib 13 making contact with its bottom rib which prevents the drawer 22 from "turning sidewise" or spilling its contents.

Figure 24:
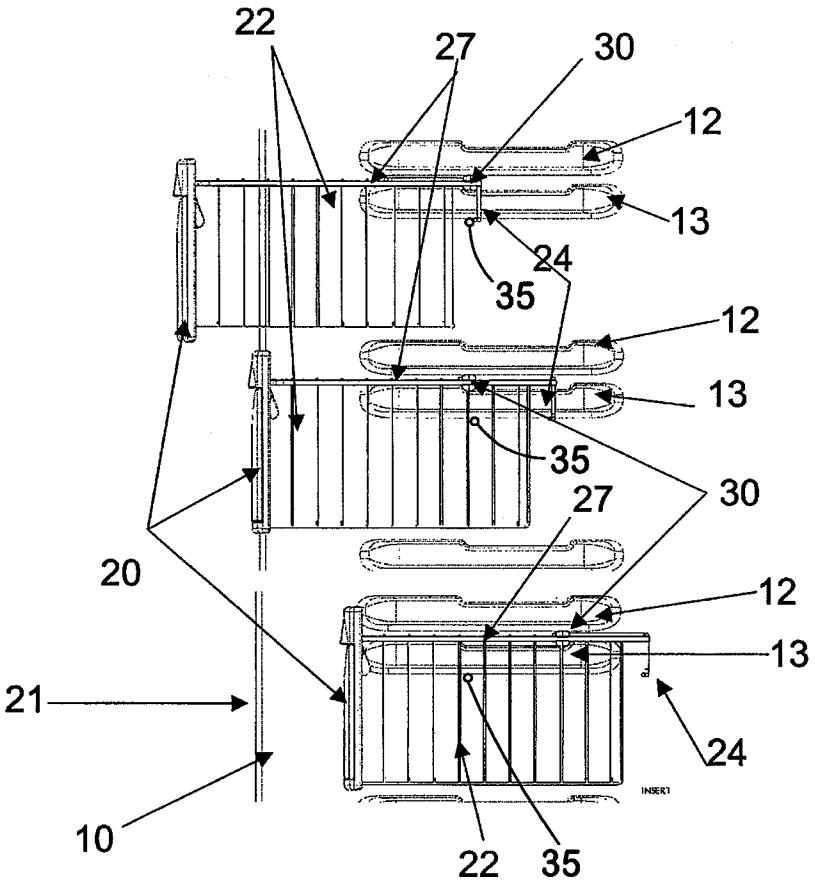
Figure 25:
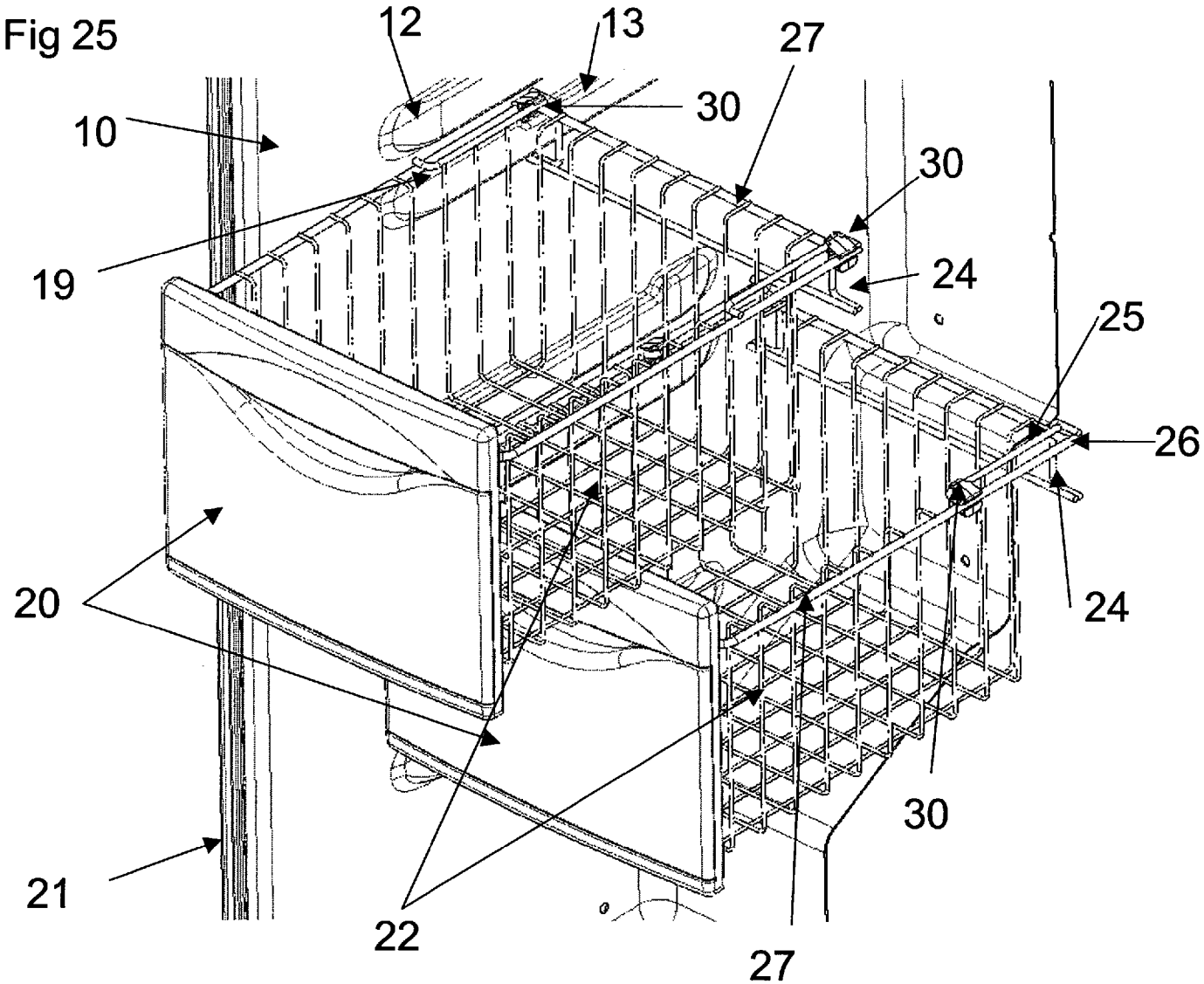

FIG. 24 shows three different positions of the drawer 22 in relation to the freezer cavity 21. The top drawer 22 is fully pulled out, the middle drawer 22 is at halfway and the bottom drawer 22 is at standstill position. In one example embodiment, a stop 35 may be disposed in a bottom side of at least one of the ribs to limit travel of the C-guide 24. On the other hand, FIG. 25 shows an isometric view of two drawers 22 inside the freezer cavity 21. The top drawer is fully pulled out while the bottom drawer is at standstill position. This figure is particularly useful to show the extra opening distance obtained by implementing the present invention, maximizing the opening extension and giving the user a better solution for storing bulky objects with ease by means of a low-maintenance, reliable mechanism made up of few pieces, easy to manufacture and apt for use under extreme conditions.

Figure 26A:
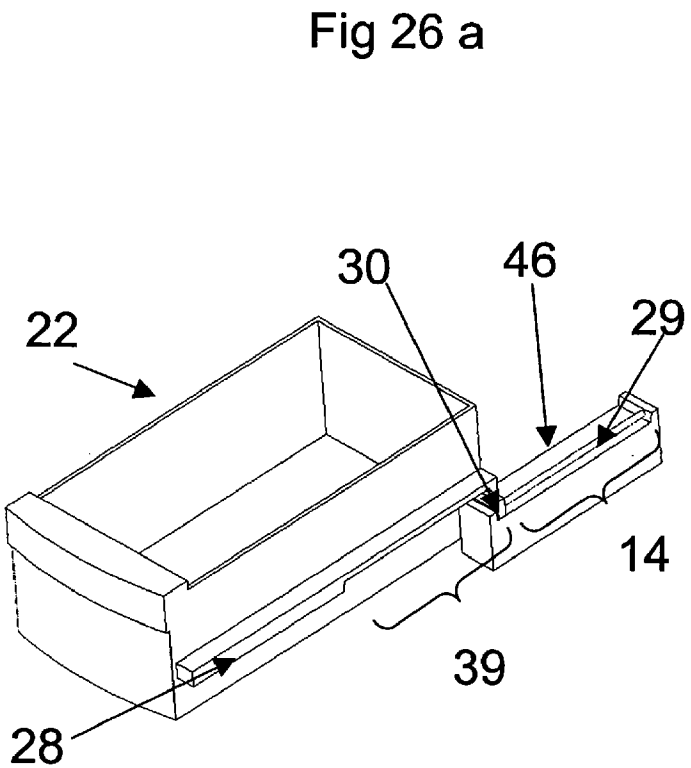
Figure 26:
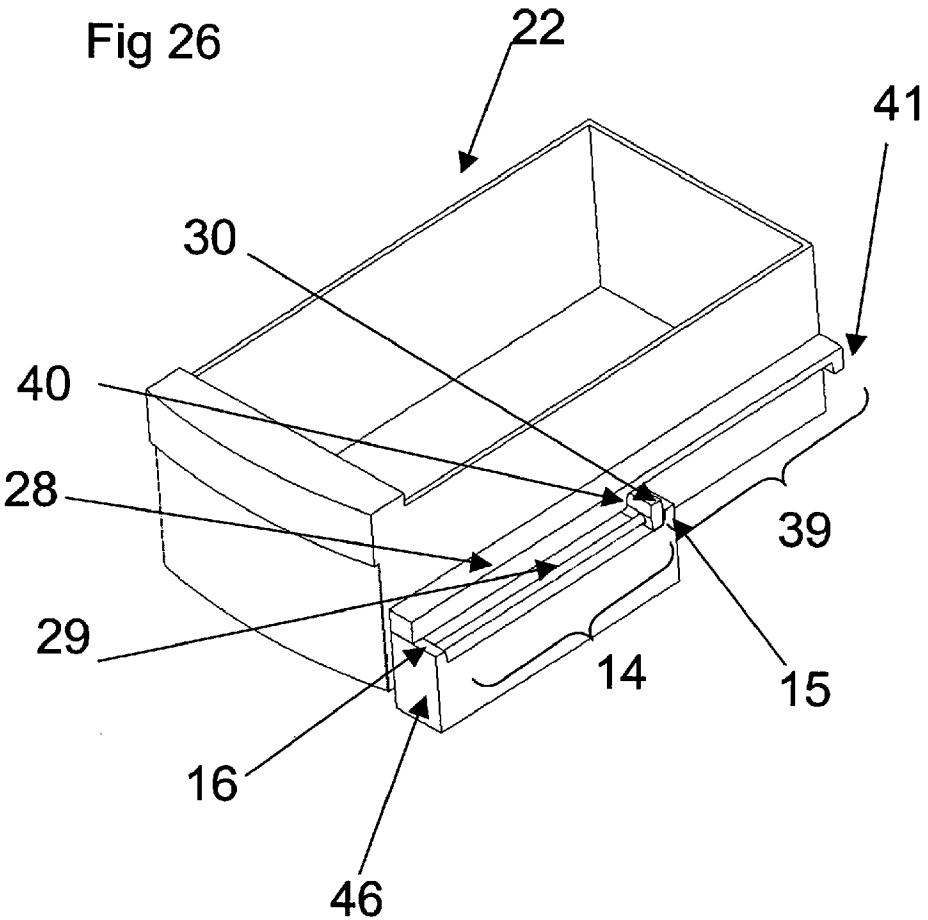

FIGS. 26 and 26*a* show an example alternate embodiment of the invention, where the slides 25 and 26 are not positioned on the back lateral end of the drawer 22. Instead there is a rod 29 placed between the stops 16 and 15 across the recess 14, which is in turn placed over the upper side of the support 46. The runner 30 runs backwards and forwards over said rod 29, its travel distance is limited by the length of the recess 14 and the stops 16 and 15. When the drawer 22 is pulled out, the drawer seat 28 slides over the supports 46. Said supports 46 may not be molded or thermoformed on the liner 10 such as the ribs 11, 12 or 13, instead they may be manufactured from assorted materials, preferably an injected plastic. They are placed over the vertical walls of the freezer cavity 21 by means of, including but not limited to, screws, adhesive, rivets, snap assembly, retainers, etc. Said drawer seats 28 are connected respectively to the vertical lateral walls of the drawer 22. This structure bears the weight of the drawer 22 and its contents. Said drawer seats 28 must be provided with a drawer seat recess 39 over the bottom side of said drawer seats 28, limited by a front stop 40 and a back stop 41. The runner 30 travels across the length delimited by the drawer seat recess 39 and the stops 40 and 41, producing a longer opening distance. It is evident that other support (not shown) placed in the liner 10 wall is necessary to stop the drawer 22 from falling down when it is being pulled out. Said support may be thermoformed or molded on the vertical walls of the liner 10 or an assorted piece is overlapped in the vertical walls of liner 10. This embodiment may have a C-guide 25, which clings to the rib 12 or 13 (depending on the position) or the support 46 and prevents the drawer 22 from falling down when being pulled out.

Figures 27, 27A:
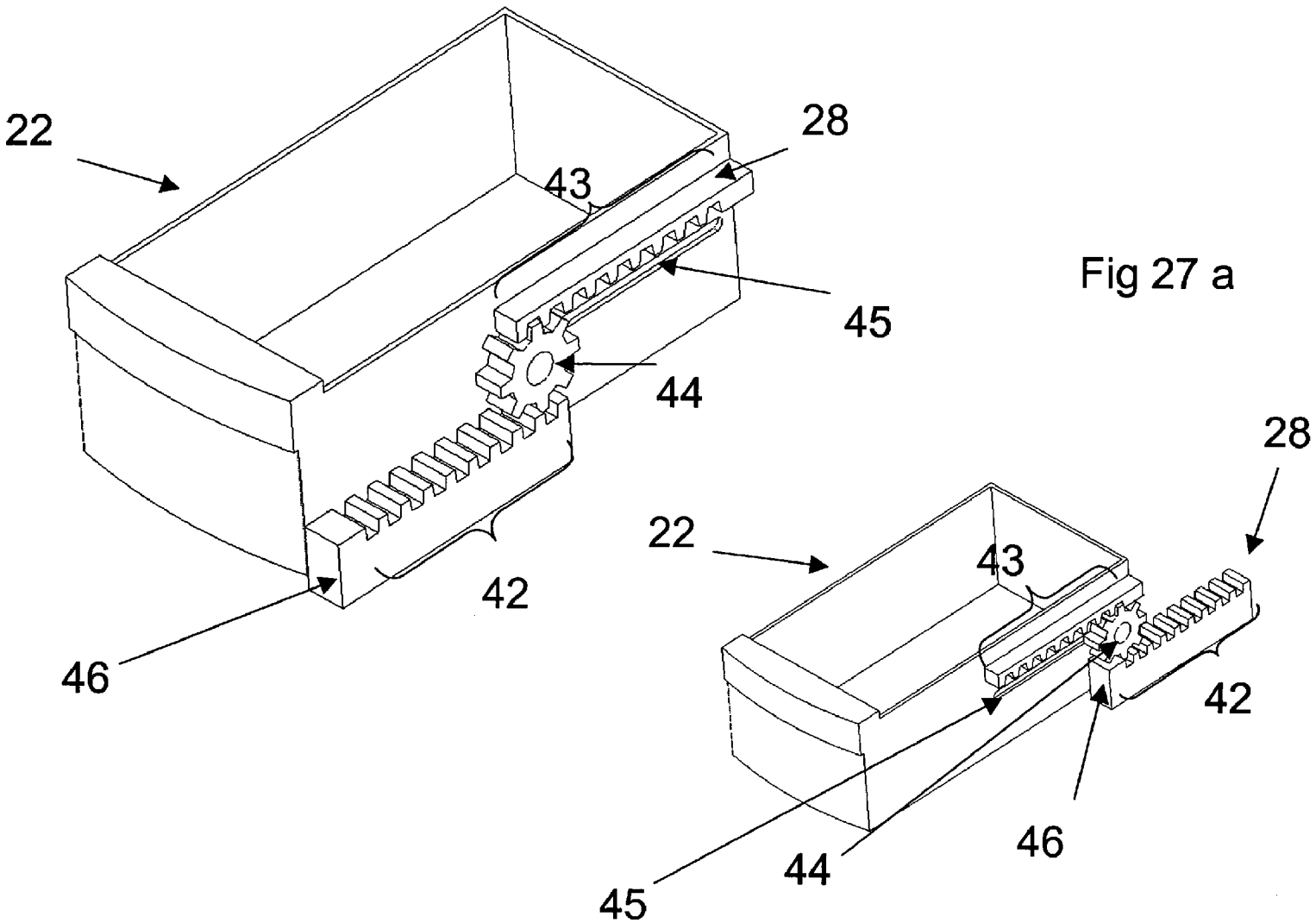

Other example alternative embodiment of the present invention is shown in FIGS. 27 and 27*a*. In said embodiment the drawer 22 is provided with a rack bar and pinion system in the outer side of its vertical lateral walls. Now the drawer seat 28 has its bottom side provided with a rack bar 43 and the support 46 is provided with a pinion 42 on its top side, over support 46 a pinion 44 travels guided over the slot 45, whose extent depends on the length of racks 42 and 43. The travel distance of said pinion 44 may be delimited by the extent of the slot 45 or the length of the rack bars 42 or 43, which preferably have the same number of teeth. In this embodiments it is evident that the stops at the end of the travel of the recess 14 are unnecessary, since the pinion 44 can only engage the rack bars 42 and 43. When the drawer 22 is pulled out, the drawer seat 28 slides over the pinion 44 and in turn this slides over the support 46. This piece may not be molded or thermoformed on the liner 10 like the ribs 11, 12 or 13, but instead is manufactured from assorted materials, preferably an injected plastic, and is placed over the vertical walls of the freezer cavity 21 by means of, including but not limited to, screws, adhesive, rivets, snap assembly, retainers, etc. Thanks to the rack bars 43 and 42 respectively, the pinion 44 may have a protruded bulge extruded at its axial axis (not shown). Said bulge enters into the slot 45 which will guide the travel of pinion 44; hence this mechanism also allows the drawer 22 to be pulled out smoothly and uniformly a greater distance, because this mechanism has the advantage of minimizing friction between pieces. Since unsafe positions of the drawer 22, which may cause it to fall down or get out of position inadvertently, are avoided, the appealing by the user is also improved. It is evident that other support (not shown) placed in the liner 10 wall is necessary to stop the drawer 22 from falling down when it is being pulled out. Said support may be thermoformed or molded on the vertical walls of the liner 10 or an assorted piece is overlapped in the vertical walls of liner 10. This embodiment may have a C-guide 25, which clings to the rib 12 or 13 (depending on the position) or the support 46 and prevents the drawer 22 from falling down when being pulled out.

Having described the invention in sufficient detail, it is considered that the same is sufficiently innovative, and without limiting the scope of the invention disclosed herein, any modification to the same, no matter how subtle, may fall within the scope of protection sought according to the following claims.

The invention claimed is:

1. A slide system and a retractable compartment in an appliance, the system comprising:

a pair of parallel vertical liner each having a set of mutually opposite ribs, each rib defining at least one recess, the ribs arranged to support a respective frame of the retractable compartment and allow slidable movement to the compartment;

a set of slides in the retractable compartment extending along a perpendicular direction relative to a lateral back end of the retractable compartment; and at least one runner disposed to travel along a corresponding slide, the travel of the runner limited by the recess in the ribs, wherein the runner is configured to travel along a channel that extends between two consecutive vertically-spaced ribs arranged to provide an extra-travel distance to the retractable compartment, the system further including a C-guide disposed at the lateral back end of the retractable compartment, the C-guide arranged to prevent a rotational movement of the retractable compartment about the slides through the runner insert by engaging one of the ribs in a pulled-out position.

2. A slide system and retractable compartments in an appliance, the system comprising:

a pair of parallel vertical liner each having a set of mutually opposite ribs, each rib defining at least one recess, the ribs arranged to support a respective frame of a retractable compartment and allow a reciprocating rectilinear movement to the compartment;

a set of slides in the retractable compartment extending along a perpendicular direction relative to a lateral back end of the retractable compartment; and at least one runner disposed to travel along a corresponding slide, the travel of the runner limited by the recess in the set of ribs, wherein the runner includes a camber having two surfaces configured to define a coupling angle ranging from 15 degrees to 65 degrees, the range of the coupling angle chosen to permit the runner to travel along a C-channel that extends over at least two consecutive vertically-spaced ribs arranged to provide an extra travel distance to retractable compartments of the slide system, the system further including a C-guide arranged to run outside one of the ribs, and a stop disposed in a bottom side of at least one of the ribs to limit travel of the C-guide.

3. The slide system of claim 2, wherein the C-guide is disposed at the lateral back end of the retractable compartment, the C-guide arranged to prevent a rotational movement of the retractable compartment about the slides through the runner.

4. The slide system of claim 2, wherein the runner comprises a rail arranged to receive a bottom slide, and a guiding slot arranged to receive an upper slide.

5. The slide system of claim 4, wherein the runner is made of plastic.

6. The slide system of claim 4, wherein the runner is made of metal.

7. The slide system of claim 4, wherein the runner is made of graphite.

8. The slide system of claim 2, wherein the retractable compartment is selected from the group consisting of a drawer, a shelf, and a grill.

* * * * *